US006993889B2

(12) United States Patent
Ford et al.

(10) Patent No.: US 6,993,889 B2
(45) Date of Patent: Feb. 7, 2006

(54) PRODUCT PACKAGING SYSTEM

(75) Inventors: Colin Ford, Woodstock, GA (US); Thomas Rice, Cumming, GA (US); Steven Brown, Canton, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 10/612,502

(22) Filed: Jul. 3, 2003

(65) Prior Publication Data

US 2004/0068967 A1 Apr. 15, 2004

Related U.S. Application Data

(60) Provisional application No. 60/418,401, filed on Oct. 15, 2002, provisional application No. 60/418,404, filed on Oct. 15, 2002.

(51) Int. Cl.
*B65B 3/24* (2006.01)

(52) U.S. Cl. ..... 53/475; 53/540; 53/543; 53/237; 53/240; 53/249; 53/251; 53/252

(58) Field of Classification Search ..... 53/475, 53/540, 543, 237, 240, 249, 251, 252, 253; 198/456, 890, 419.3
See application file for complete search history.

(56) References Cited

U.S. PATENT DOCUMENTS

| | | | | |
|---|---|---|---|---|
| 4,899,790 | A * | 2/1990 | Odenthal | 141/134 |
| 5,175,976 | A * | 1/1993 | Petry et al. | 53/252 |
| 5,388,389 | A * | 2/1995 | Tisma | 53/473 |
| 5,452,568 | A * | 9/1995 | Tisma | 53/579 |
| 5,481,848 | A * | 1/1996 | Tagliaferri et al. | 53/157 |
| 5,551,217 | A * | 9/1996 | Huening et al. | 53/474 |
| 5,579,895 | A * | 12/1996 | Davis et al. | 198/456 |
| 5,657,610 | A * | 8/1997 | Dietrich et al. | 53/139.5 |
| 5,664,407 | A * | 9/1997 | Cooper et al. | 53/542 |
| 5,852,912 | A * | 12/1998 | Chalendar | 53/201 |
| 6,170,237 | B1 * | 1/2001 | Wipf | 53/455 |
| 6,202,392 | B1 * | 3/2001 | Greenwell et al. | 53/566 |

* cited by examiner

*Primary Examiner*—Stephen F. Gerrity
*Assistant Examiner*—Hemant M. Desai
(74) *Attorney, Agent, or Firm*—Womble Carlyle Sandridge & Rice, PLLC

(57) ABSTRACT

A product packaging system for receiving a series of products from one or more product transport lines. The products are loaded into a series of carriers and transported through a downstream inserter unit. Inserter assemblies moving in timed relation with the movement of the carriers through the inserter unit engage and urge the products out carriers and into a carton for packaging.

25 Claims, 10 Drawing Sheets

PRODUCT PACKAGING SYSTEM

CROSS REFERENCE TO RELATED APPLICATION

This application claims priority to U.S. provisional application Ser. No. 60/418,401, filed Oct. 15, 2002, and U.S. provisional application Ser. No. 60/418,404, filed Oct. 15, 2002.

FIELD OF THE INVENTION

The present invention relates to methods and systems for packaging products, and in particular, to methods and systems for packaging irregularly shaped and/or difficult to control products or articles in stacked configurations within a carton.

BACKGROUND OF THE INVENTION

In recent years, various alternative types of product packages or containers, such as juice boxes or pouches in which a plastic, foil, or paperboard tube or sleeve is filled with a liquid beverage or other bulk material and then sealed, have become popular, lightweight alternatives to conventional disposable beverage packaging, such as bottles and cans. Typically, such packages or containers are arranged in parallel rows of two, three, four, five, etc. packages, to form four-packs, six-packs, ten-packs, etc., and are then shrink wrapped or placed in paperboard cartons for sale. Unlike bottles or cans, such juice boxes or pouches often are flexible and have irregular shapes or configurations that can be difficult to control, thus creating special problems with the handling and packaging of these containers.

For example, most juice pouches generally tend to be soft-sided foil tubes that have a tapered configuration, extending from an expanded, rounded bottom upwardly toward a flattened upper or top portion, and further can be formed with an hourglass or other irregular shapes or configurations such that they are not readily stackable one on top of another. Such pouches or similar containers further often will have fins along their upper and side edges where the foil or paperboard material has been sealed, which fins also can be engaged or otherwise interfere with the movement of the pouches along the packaging line. In addition, many of these type containers also typically have straws attached along their front or rear panels. These straws are generally attached with a bead of adhesive, approximately along the center of the straw, and given the irregular shapes of such containers, typically do not lie flush against the panel of the container. As a result, there is a significant danger during the handling of such containers that the straws can become caught, dislodged, or pulled away from the packages. In such an event, the packages will have to be pulled out of the packaging line. The loose straws further can interfere with the downstream movement and packaging of the remaining pouches.

Still further, it generally is desired to package juice pouches, or similar flexible containers together in a tight formation so that they can be packaged in as small a carton as possible to avoid waste. Therefore, after stacking, the pouches generally have to be compressed or urged together into a tighter formation for packaging, which can compound the problems of handling such packages. Consequently, the problems with material handling of such pouches due to their irregular sizes and shapes, as well as the application of straws thereto, typically significantly limit packaging rates for the pouches in order to try to minimize the potential problems with packaging such containers in cartons. This correspondingly limits the production of the containers themselves and/or requires additional packaging lines to handle the supply of containers, which is not always practical or cost effective.

Accordingly, it can be seen that a need exists for a method and system for reliably and efficiently packaging pouches and other irregularly shaped products in cartons that enable the packaging of such containers at increased rates and which addresses these and other related problems in the art.

SUMMARY OF THE INVENTION

Briefly described, the present invention generally comprises a system and method of packaging various types of products within cartons or other containers. The packaging system of the present invention generally receives a series of products and moves them along a path of travel along a product input or transport conveyor line. The products are received at an upstream input or loading end of a carrier conveyor having a series of product carriers moving therealong toward a downstream inserter unit.

Each of the product carriers generally includes a pair of opposed side walls or plates defining a pocket or receptacle in which one or more products, and typically two or more products, are received in a stacked or nested configuration. The side plates of the carriers include base portions that are interlocked together about a central hinge pin or rod, and actuation pins mounted along the outer edges of the base portions. Notches or channels also can be formed in the base or lower portions of the plates for receiving a guide rail therein to guide the movement of the carriers. In addition, the side plates of the carriers can be symmetrical, however, it is also possible that the side plates can be asymmetrical, with one plate including an asymmetric stacking feature adjacent at the base portion thereof to facilitate stacking of the products within the carriers.

The carrier conveyor includes a first, input or loading end, a down-stream second or discharge end, and guide rails along which the carriers are guided along their path of travel. A loading station is defined at the input or loading end of the carrier conveyor, and generally includes one or more drive or loading sprockets about which the carriers are moved. The drive sprockets each include a series of teeth, typically arranged in groups of three teeth defining recesses therebetween. The actuator pins of each carrier are received within the recesses between the center tooth and each of the outer teeth of each group, such that the center tooth will engage and urge the hinge pin upwardly so as to cause the side walls of the carriers to spread and thus enlarge the product receiving pocket for receiving the products therein.

After loading, the carriers are moved along the carrier conveyor and are discharged or fed into the downstream inserter unit. The inserter unit generally includes a carrier transport, such as a conveyor having a series of spaced supports received within bottom recesses formed in the bases of the carriers for supporting and moving the carriers through the inserter unit, and a funnel conveyor having a series of product funnels for funneling a group of products together to form a product package or group. The inserter unit further includes a series of inserter assemblies conveyed in timed relation with the movement of the carriers. The inserter assemblies include inserter rods moveable between a retracted, non-engaging position, and a fully extended, engaging position extending into and through their corresponding carriers so as to engage and urge the stacked products out of the carriers into and through the funnels of the funnel conveyor.

At the same time, a carton transport conveyor positioned on the opposite side of the funnel conveyor from the carriers moves a series of product cartons in timed relation with the movement of the carriers. Thus, as a group of products is moved by the inserter rods out of their carriers and through a funnel of the funnel conveyor, the products will be urged into a corresponding product carton. Thereafter, the inserter rods will be moved to their retracted, non-engaging position as the cartons are transferred or otherwise conveyed away from the inserter unit for sealing and shipment, while the now empty carriers generally are routed back to their carrier conveyor.

Where multiple product transfer lines are used to supply products to the packaging system of the present invention, multiple carrier conveyors can be provided for receiving products from each product transport line, and thereafter will feed their carriers through a selector and metering station, which will meter the product carriers from the various lines into the inserter unit. The carriers can be fed into the inserter unit in staggered, separate lines and progressively merged into a single line of carriers. The inserter rods also typically will be moved laterally across the width of the inserter unit, tracking the movement of their associated carriers together to form the single line of carriers, after which the inserter rods will urge their products through a funnel of the funnel conveyor and into a waiting carton. Alternatively, the multiple product transport lines can be fed to a loading station for a single carrier conveyor, with alternate ones of the products from each product transport line being loaded in the carriers without requiring the merger of multiple lines of carriers downstream. In addition, the loading system can further include a cammed section along which the funnels will be moved from a first, central position between the inserter unit and carton conveyor, into a second, inner position alongside the carriers to receive the product; and then to a third, outer position in registration with a corresponding carton to ensure a smooth transition of the stacked products through the funnels and into the cartons.

Various objects, features and advantages of the present invention will become apparent to those skilled in the art upon reading the following specification when taken in conjunction with the accompanying drawings.

DETAILED DESCRIPTION

Figure 1A:
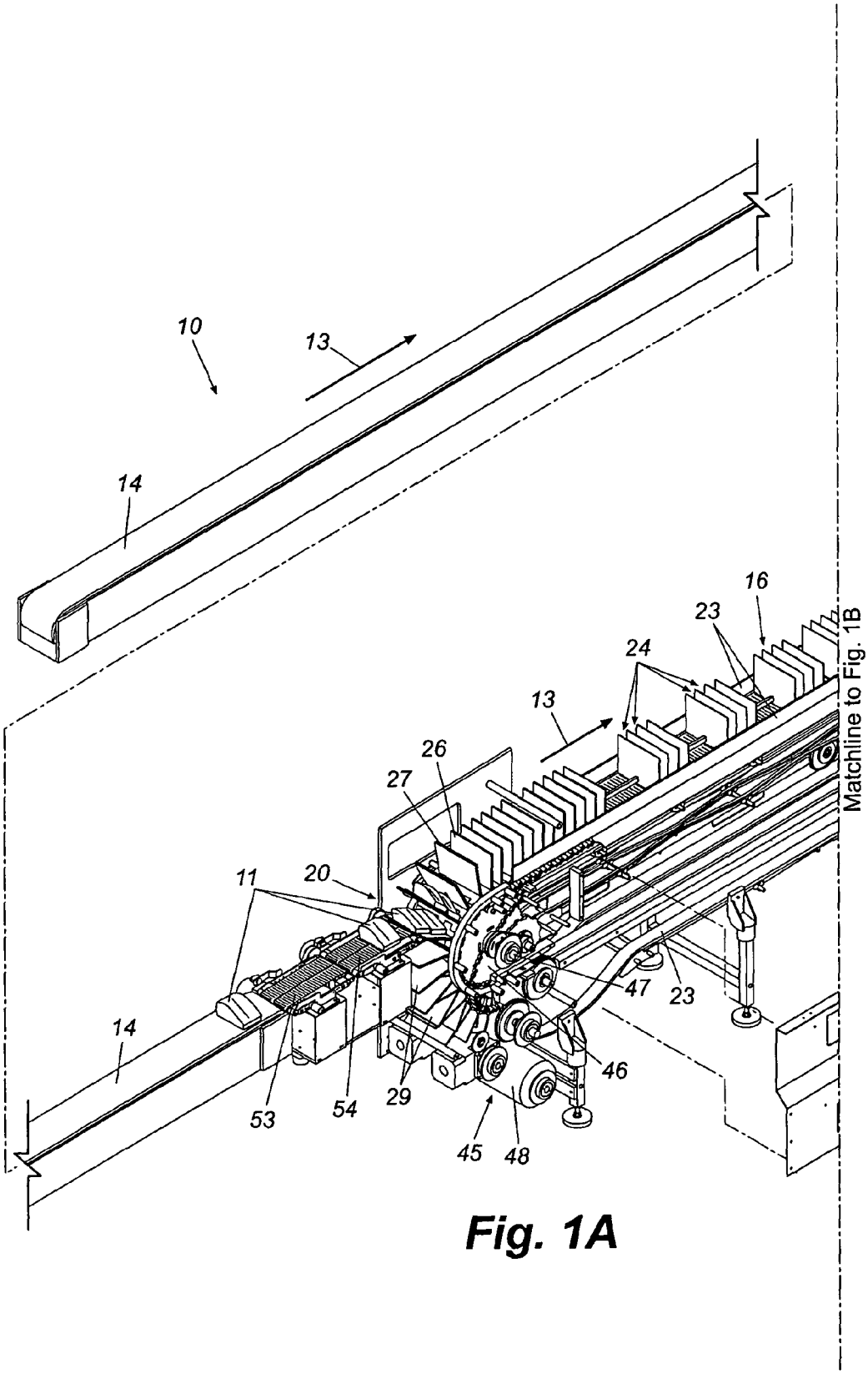
FIG. 1A is a perspective view of the product packaging system of the present invention for loading products into cartons.
Figure 1B:
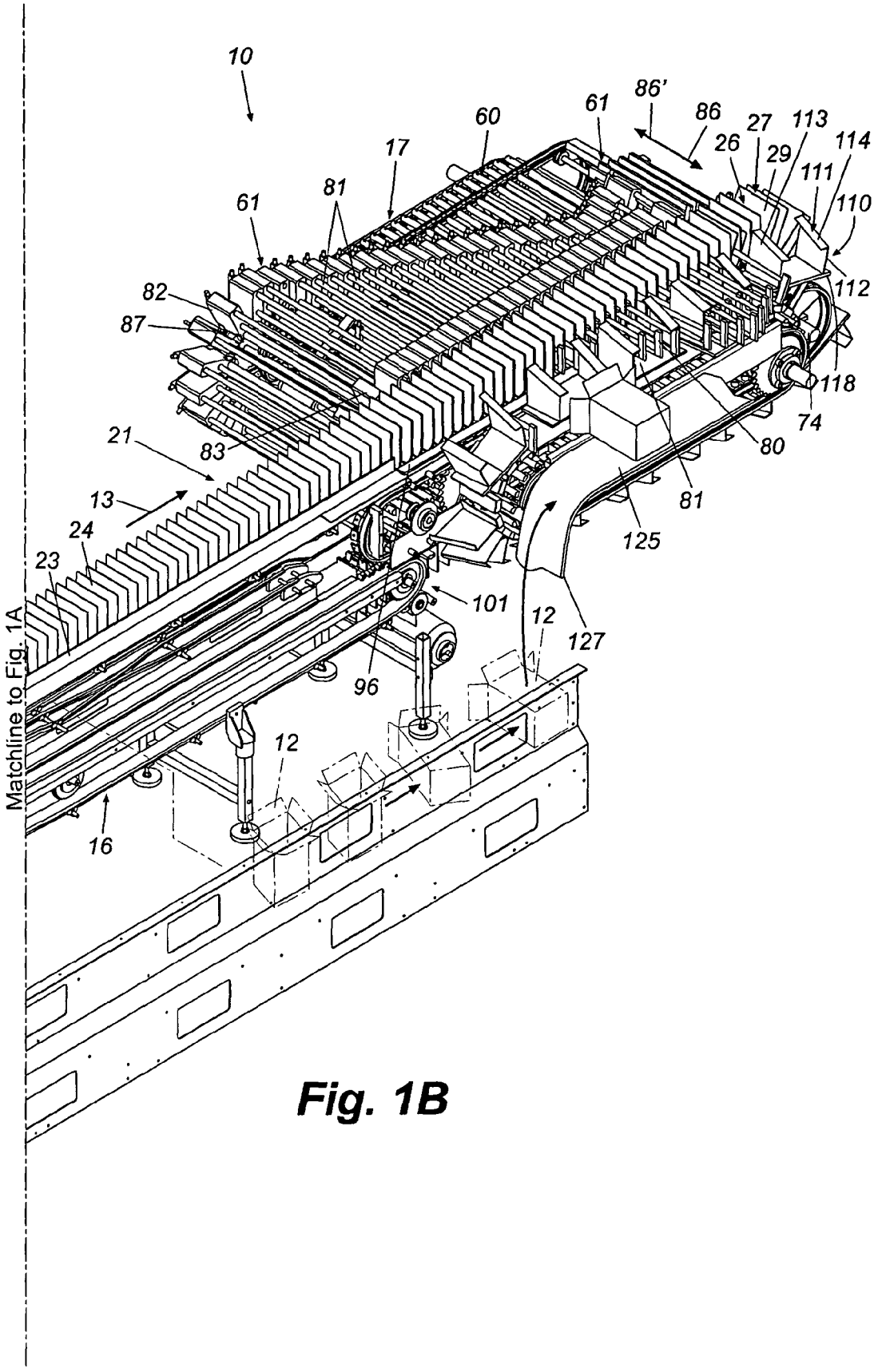
FIG. 1B is a perspective view of the inserter unit of the present invention downstream of FIG. 1A.

Referring now in greater detail to the drawings in which like numerals indicate like parts throughout the several views, FIGS. 1A and 1B generally illustrates example embodiments of the packaging system 10 of the present invention for receiving, grouping and packaging a series of products 11 within corresponding cartons 12 for shipment and sale. The packaging system 10 is generally shown for use in packaging irregularly shaped, hard to handle products such as juice pouches, which further are typically soft-sided and not readily stackable. However, it will be understood by those skilled in the art that while the present invention is illustrated as being adapted for packaging irregularly shaped products 11 such as juice pouches or other similar flexible packages, it will also be possible to convey, group and package a variety of other different types or configurations of products within the cartons 12 or various other types of containers, through the use of the present invention.

Figure 1C:
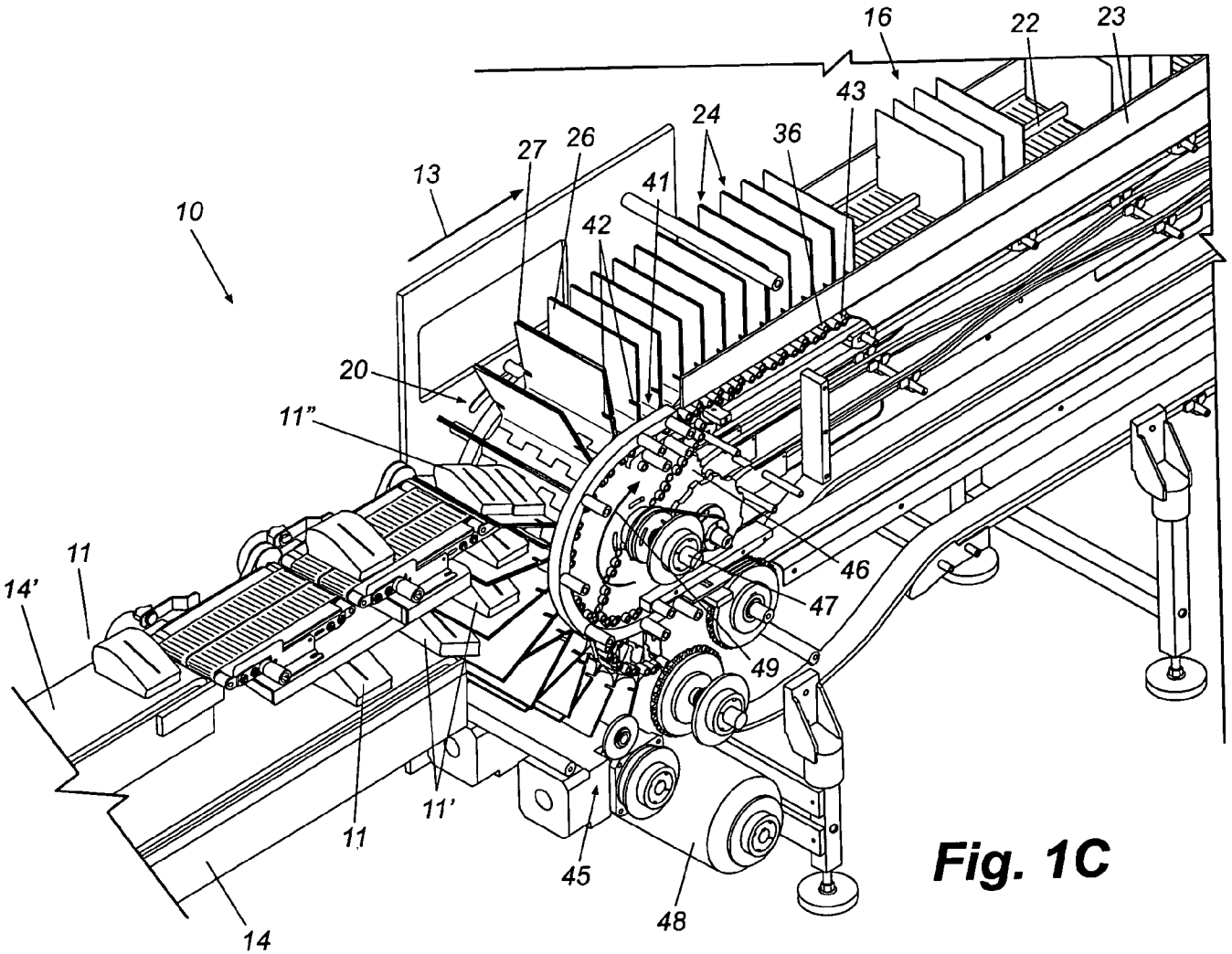
FIG. 1C is a perspective view of an alternate embodiment of the carrier loading station for receiving products from multiple product transfer lines.

As illustrated in FIG. 1A, the packaging system 10 of the present invention generally receives a series of products 11 being transported along a path of travel, indicated by arrows 13, with the products being moved in spaced series along a loading or transport conveyor line 14 from at least one upstream product forming or filling machine(s) (not shown). The packaging system 10 (FIGS. 1A and 1B) generally includes a carrier conveyor 16 at a first or upstream end thereof, and a downstream inserter unit 17 that inserts the products 11 within their cartons 12. The carrier conveyor 16 generally includes a first, upstream input or loading end 20, a second, downstream or discharge end 21, and a center support rail 22 and side guide rails 23 for guiding a series of product carriers 24 between the ends of the carrier conveyor along the path of travel 13 and into the inserter unit 17. Alternatively, as illustrated in FIG. 1C, the packaging system 10 can receive products 11 from multiple product transport lines 14 and 14', which feed their products into the carriers at two locations around loading sprocket 46.

Figure 2:
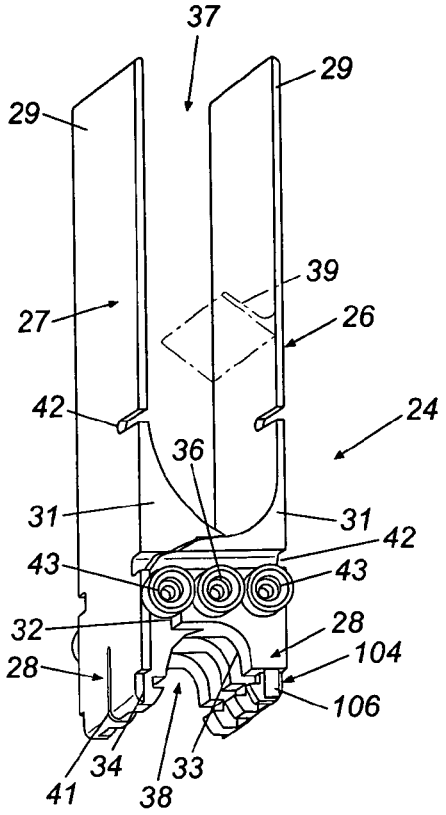
FIG. 2 is a perspective view of a carrier.
Figure 4:
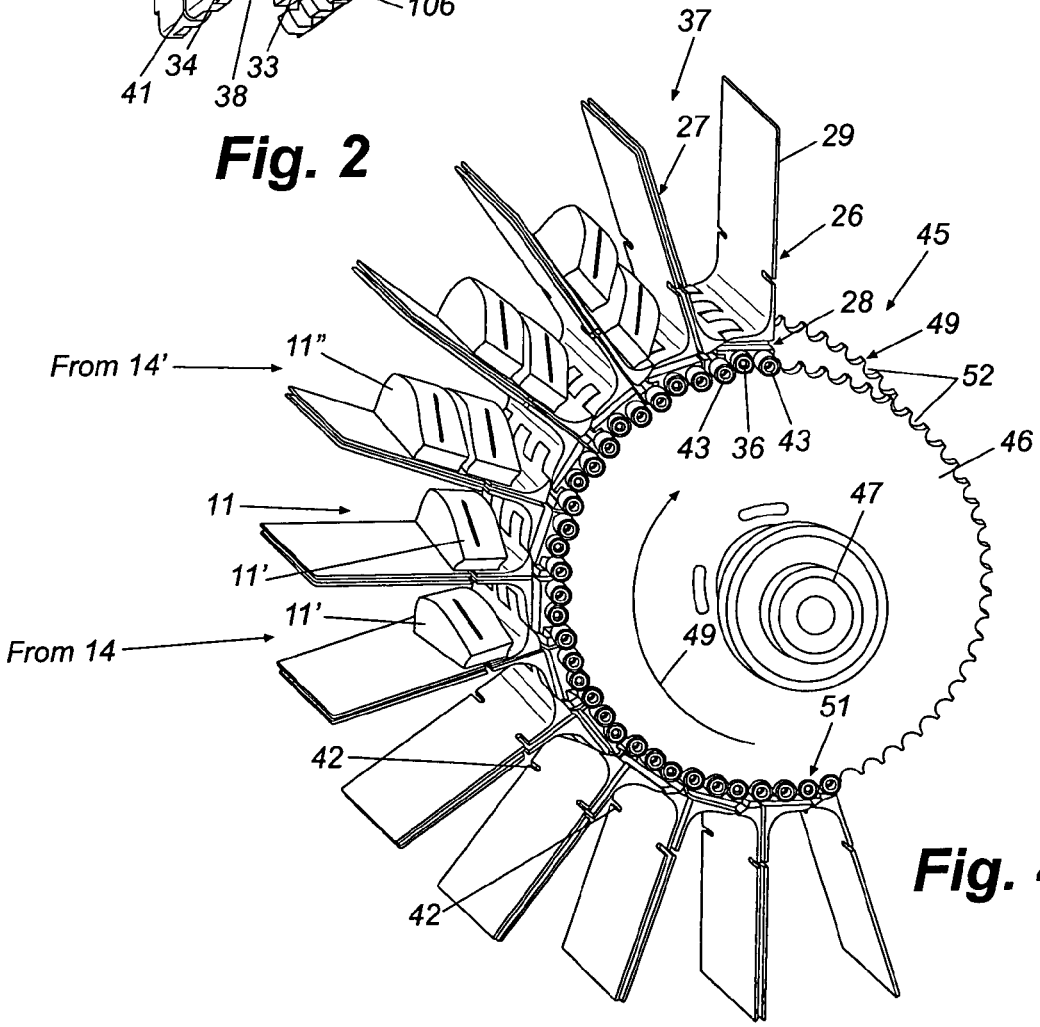
FIG. 4 is a perspective view of the carriers moving about their loading sprocket.
Figure 3A:
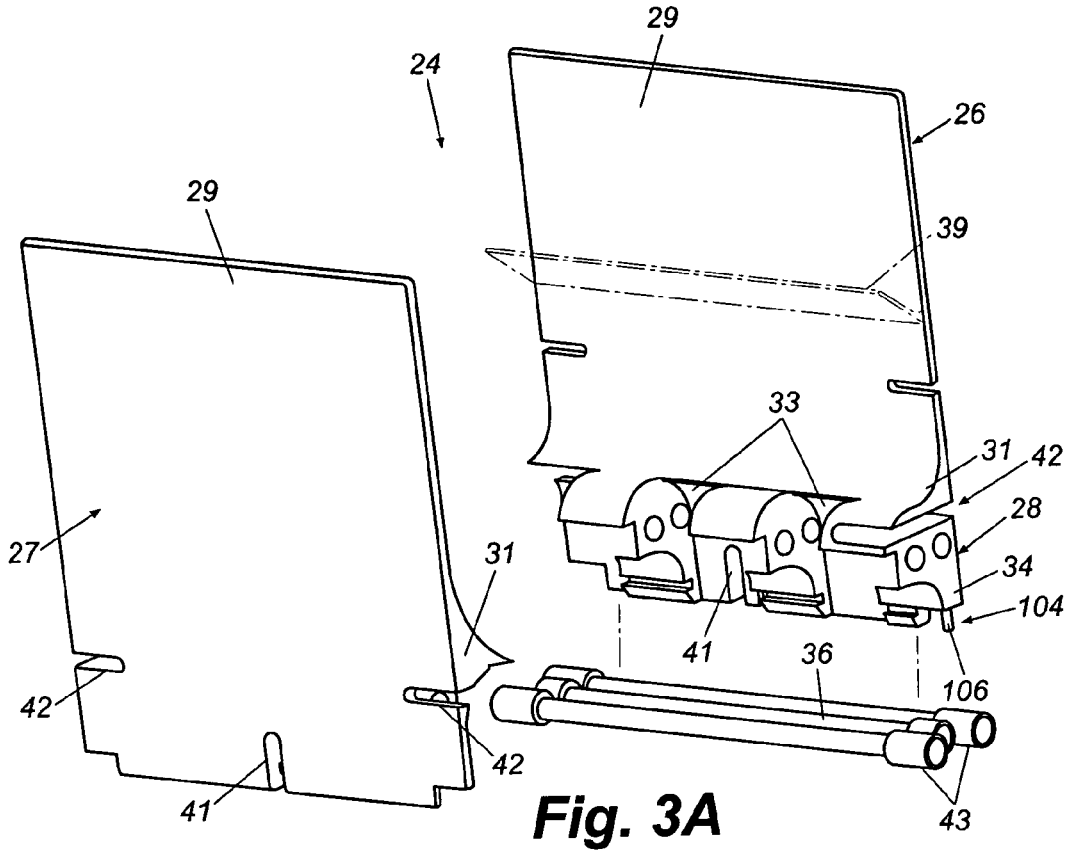
FIGS. 3A–3B are exploded perspective views illustrating the side walls, hinge pins and actuation pins of the carriers.
Figure 3B:
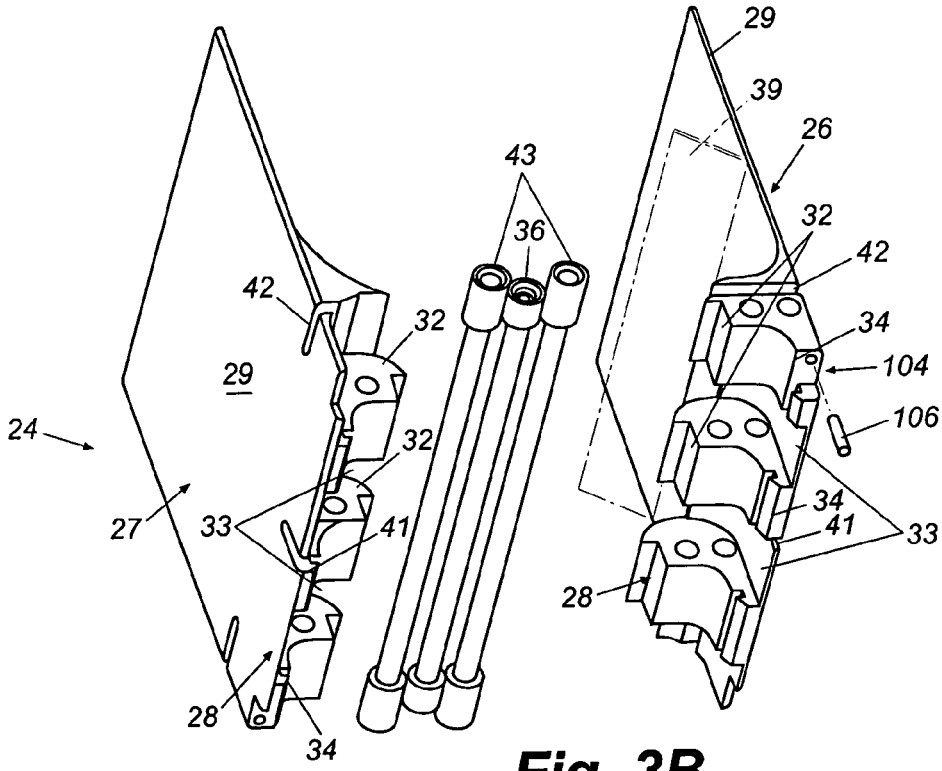

As illustrated in FIGS. 2–4, each of the carriers 24 generally includes a pair of opposed side plates 26 and 27 that each include a base portion 28, an upper side wall 29 and a sloping shoulder portion 31 between the side wall and base thereof. The side plates generally can be formed from an extruded or injection molded plastic or other synthetic material, or also can be formed from a metal material such as aluminum or steel. As further illustrated in FIGS. 3A and 3B, the base portion 28 of each side plate 26 and 27 includes a series of spaced projections or flanges 32 defining recesses 33 therebetween, and downwardly extending legs 34. The flanges 32 of the base portions 28 of the side plates 26 and 27 are adapted to fit together in an intermeshing relationship with their respective projections 32 being received in the recesses of the opposing side plate and with the side plates being pivotally attached together by a central hinge pin 36.

In their interlocked configuration, the upper side walls 29 and shoulder portions 31 of the side plates 26 and 27 define an open ended product receiving recess 37 in which the products typically will be received, while a bottom recess 38 is defined in the bottom of each carrier between the legs 34 thereof. The size of the pocket 37 generally is selected to enable the receipt of the largest or thickest products being packaged by the packaging system 10 of the present invention, while still enabling the products to be stacked one on top of another.

Additionally, the side plates 26 and 27 generally will be substantially symmetrical, i.e., they can be formed from the same mold, and thus have the same structure or configuration. The side plates also can be asymmetrical, with one side plate including an additional asymmetrical stacking feature. For example, as shown in FIGS. 2–3B, the shoulder portion 31 of one of the side plates 27 can be of an increased thickness so as to naturally guide the bottom products stacked therein into a substantially upstanding attitude to ensure the next product received in the pocket will be stacked on top. Alternatively, one of the side plates can include an inwardly projecting flange or additional support wall, indicated at phantom lines 39 in FIGS. 2 and 3A–3B, projecting upwardly into the pocket 37 of the carrier to provide additional support and ensure that the upper product will be stacked on top of the lower product receive therein and to help minimize side by side nesting of the products within the carriers.

It further will be understood by those skilled in the art that while a pair of products is shown as being received and stacked within each of the carriers, it is also possible to place only a single product within each carrier, or stack more than two products in each carrier as desired or needed for packaging the products in groups, such as for two-packs, four-packs, eight-packs, ten-packs, etc. Still further, as illustrated in FIGS. 2–3B, a center guide channel 41 is formed through the legs 34 of the base portion 28 for receiving the center rail of the carrier conveyor therein. Side recesses or channels 42 are formed in the side plates 26 and 27 for receiving the side guide rails 23 (FIG. 1A) therein to help guide and maintain the carriers 24 in an upstanding and closed attitude as they are moved along the carrier conveyor and transferred to the inserter unit 17. The carriers further also generally include a pair of actuator pins 43 that extend through the base portions 28 of the respective side plates 26 and 27.

As illustrated in FIGS. 1A and 4, a loading station 45 is provided at the input upstream loading end 20 of the carrier conveyor 16, at which the products 11 are received and stacked within their respective carriers 24. The loading station 45 generally includes a pair of parallel drive or loading sprockets 46 mounted on a drive shaft 47 being driven by a motor 48 (FIG. 1A) in the direction of arrow 49 (FIG. 4). Each of the loading sprockets 46 includes a series of teeth 49 typically arranged in a two-pitch cycle diameter, with the teeth 49 being arranged in groups of three teeth, as generally indicated at 51, and defining recesses 52 therebetween. As indicated in FIG. 4, the actuator pins 43 of each carrier 24 are received within the recesses 52 of one of the groups 51 of teeth with the middle or center tooth of each group engaging and urging the hinge pin 36 of the carrier upwardly. This in turn causes the upper side walls 29 of the carriers to be pivoted and spread outwardly away from each other so as to further open the pocket 37 defined within the carrier. The opening of the pockets of the carriers helps facilitate the loading of products therein as indicated in FIGS. 1A, 1C and 4.

During a loading operation, the products can be loaded sequentially from a transport conveyor with the products generally being received in a substantially horizontally oriented arrangement. For example, as shown in FIGS. 1A and 4, as the products 11 are received in series from a single product transport conveyor, they will be fed onto belts 53 and 54 to ensure adequate gapping between products and then into an open pocket 37 of a carrier 24. Typically, a first or lower product 11' (FIG. 4) will be received in the carrier when the carrier is at a first loading position. Thereafter, as the carrier is incremented or indexed forwardly about the loading sprockets 46, a second or upper product 11", which is being moved immediately behind the first loaded or bottom product, will pass from the discharge end of the product transport conveyor into the open pocket.

Alternatively, as illustrated in FIG. 1C, where multiple product transport or loading conveyors 14 are used to feed multiple products 11 into a single loading station 45, the product transport conveyors 14 and 14' will be arranged so they can feed their respective products one at a time into each of the carriers. For example, as indicated in FIG. 1C, the first or lower product 11' can be fed from a first product transport conveyor 14 into a carrier, after which, as the carrier is incremented further around the loading sprockets 46 at the loading station 45, the second product 11" of each stack of products will be loaded into the carrier by the second product transport conveyor 14'. In addition, while two product transport conveyors are illustrated in the example embodiment of FIG. 1C, additional product transport conveyors also can be used for transporting products to the loading station 45 for loading in the carriers. Additionally, a monitoring system can be provided (not shown) for monitoring the flow of products along each of the product transport conveyors. If the monitoring system detects that the flow of products along the product transport conveyors has been interrupted, the other product transport conveyor(s) can be controlled so as to feed products at a greater rate for filling the pockets of the carriers as needed.

After the carriers 24 (FIG. 4) have been loaded with a series of stacked products 11, the carriers will be reoriented to a substantially upright, vertically extending attitude as they are received and urged along the center and side guide rails of the carrier conveyor 16 (FIG. 1A). As the carriers are moved along the carrier conveyor 16 along their path of travel 13, the engagement of the side rails within the side channels or recesses formed in the side plates of the carriers, tends to cause the side walls of the carriers to be pivoted toward each other toward a substantially parallel, closed position, with the products stacked therein. Thereafter, the carriers with their products stacked therein typically will be discharged from the carrier conveyor 16 at the discharge end 21 thereof and fed into the downstream inserter unit 17 (as shown in FIG. 1B).

Figure 5:
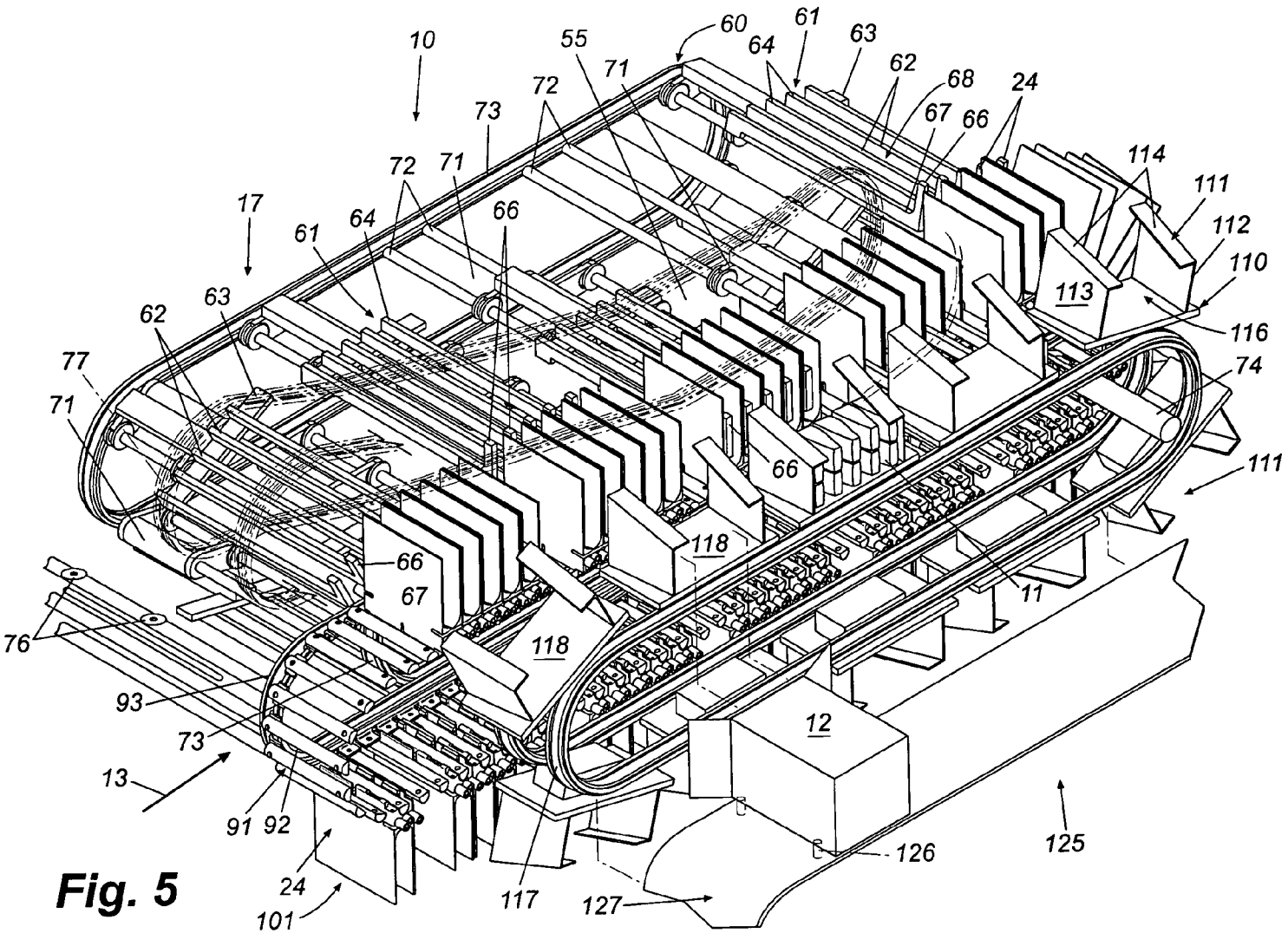
FIG. 5 is a perspective view of an inserter unit of a pitched packaging system.
Figure 6:
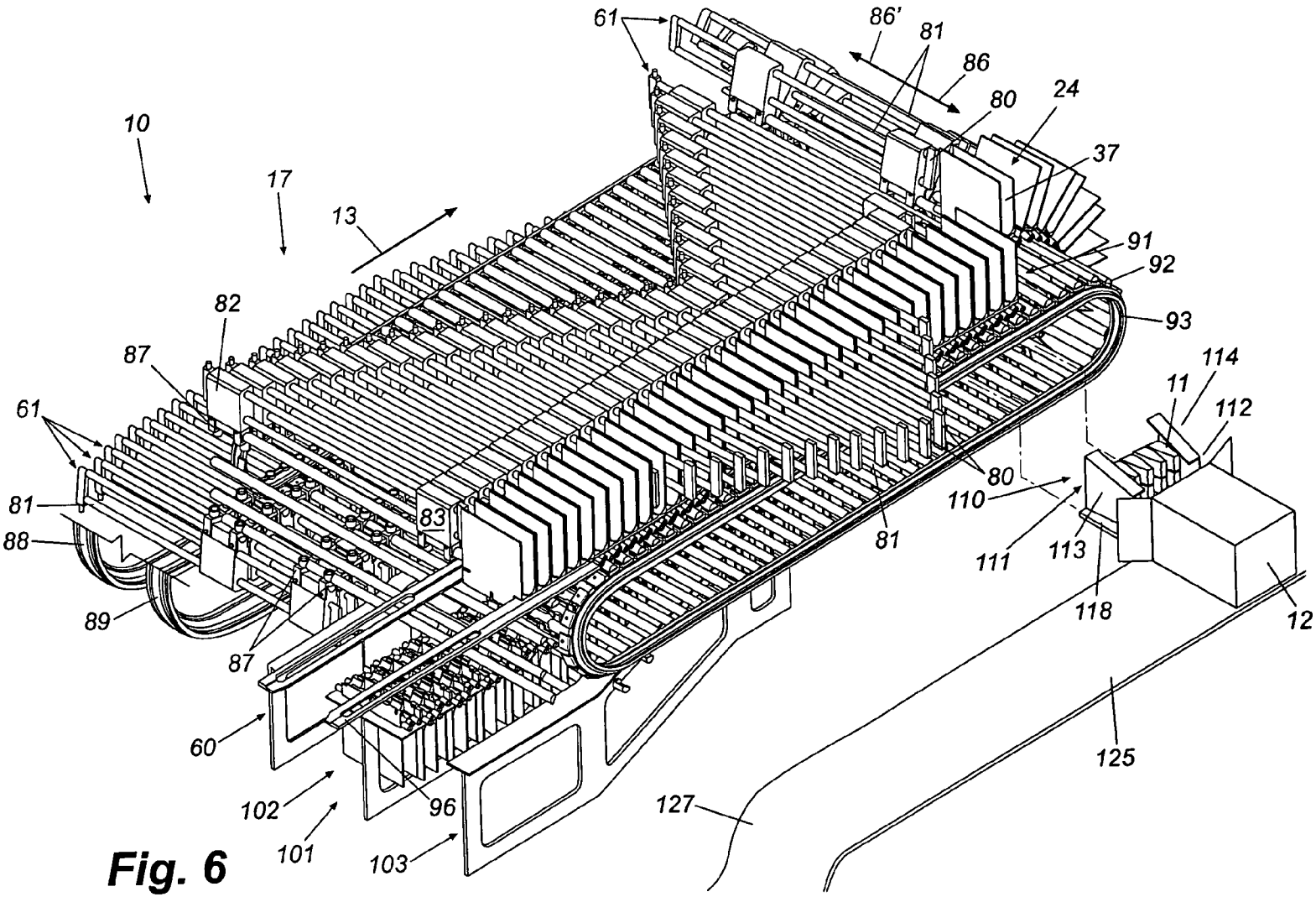
FIG. 6 is a perspective view of the inserter unit with parts broken away, illustrating the movement of the inserter rods through the carriers in an unpitched packaging system.

FIGS. 5 and 6 illustrate alternate versions of the inserter unit 17. FIG. 5 generally illustrates a pitched version of the inserter 17, wherein a selected group of products, such as indicated at 55 in FIG. 5, is urged out of a series of selected carriers 24 and into a waiting carton 12. FIG. 6 illustrates a pitchless unit, which typically will be used for progressively urging the products 11 into cartons 12 without the products being grouped together, i.e., with the carriers 24 being run back to back, thus enabling loading of varying size or configuration cartons on the same packaging line. In addition, the pitchless inserter unit of FIG. 6 typically will be used for systems wherein multiple lanes of products are merged together as discussed below with respect to FIGS. 8–9. As further generally illustrated in FIGS. 5 and 6, the inserter unit 17 includes a frame 60 on which a series of inserter assemblies 61 are mounted and moved along a substantially elliptical path into and along the path of travel 13 of the products within their carriers 24.

In the pitched inserter unit 17 shown in FIG. 5, each inserter assembly 61 generally includes a series of inserter or pusher rods 62 slideably mounted to a support or base 63 at a first or distal end 64. The inserter or pusher rods each include an upstanding pusher plate or finger 66 at a second, proximal end 67 thereof, and typically are arranged in groups or sets of inserter rods, as indicated at 68. For example, in FIG. 5, five inserter rods 62 are illustrated per group 68, though it will be understood that fewer or greater numbers of inserter rods also can be used depending upon the size and number of products 11 in each of the groups of products 55 being packaged in the cartons 12. The supports 63 to which the first ends 64 of the inserter rods 62 of each group 68 are attached typically include an elongated plate or bar that extends transversely with respect to the first ends of the inserter rods.

The supports 63 are each mounted on a carriage 71 that is slideably supported on support rods 72 that extend across the width of the inserter as indicated in FIG. 5. The ends of the support rods generally are attached to a pair of spaced conveyor belts, chains or other similar type of transport mechanisms, indicated at 73, and are driven about an elliptical path around the frame 60 of the inserter unit 17 by a drive motor (not shown) that rotates a drive shaft 74. The carriage 71 for each inserter assembly 61 further includes cam rollers or followers 76 that engage and move about cam tracks, illustrated in dashed lines 77, so as to cause the groups of inserter rods 68 of the inserter assemblies 71 to be moved laterally across the width of the inserter unit and into engagement with the stacked products within a selected group of product carriers 24 as the inserter assemblies are moved about the inserter unit.

Alternatively, in the pitchless version of the inserter unit 17 illustrated in FIG. 6, the inserter assemblies 61 are run back to back, in series, instead of being grouped in sets as shown in FIG. 5. As shown in FIG. 6, each of the inserter assemblies 61 generally includes an upstanding pusher plate or finger 80 attached to one or more support or inserter rods 81, here illustrated as a pair of rods. The inserter rods 81 generally are slideably received and supported by a support blocks or carriages 82 and 83 that are moveable in the direction of arrows 86 and 86', back and forth laterally across the inserter unit so as to move each of the inserter rods 81 and pusher plates 80 from a retracted, non-engaging position to an extended, engaging position through the pockets 37 of their carriers as indicated in FIG. 6. The slide blocks or carriages 82 and 83 further generally include cam followers or rollers 87 mounted along a lower surface thereof. The cam rollers 87 engage and roll along cam tracks 88 and 89 so as to cause the lateral movement of the inserter rods between their retracted, non-engaging position and an extended, engaging position, and for substantially tracking the movement of the carriers 24 as they are conveyed away from the cartons as indicated at the downstream end of the inserter unit 17 as shown in FIG. 6.

As further illustrated in FIGS. 5 and 6, the inserter unit 17 generally includes a carrier transport line or conveyor 91, extending about its frame 60 and including a series of spaced support bars 92 adapted to be received within the bottom recesses or channels 38 defined between the legs 34 of the carries so as to support the carriers in a substantially upstanding vertical attitude. The support bars 92 are attached at their ends to a conveyor belt, chain or the like 93 that generally is driven by the same drive shaft 74 (FIG. 5) drives the drive belts 73 for the inserter assemblies 61 so that the inserter assemblies are moved at substantially the same rate as their corresponding carriers 24 (FIG. 6) or groups of carriers 55 (FIG. 5) in timed relation therewith. As a result, as the inserter rods of each of the inserter assemblies 61, are moved laterally across their inserter unit from the retracted, non-engaging position shown at the upstream end of the inserter unit through their corresponding carriers 24 to a fully extended, engaging position, whereby the stack of products 11 within each carrier is urged out of the carrier individually as shown in FIG. 6, or substantially as a group as shown in FIG. 5 for feeding into a corresponding carton 12.

Figure 9:
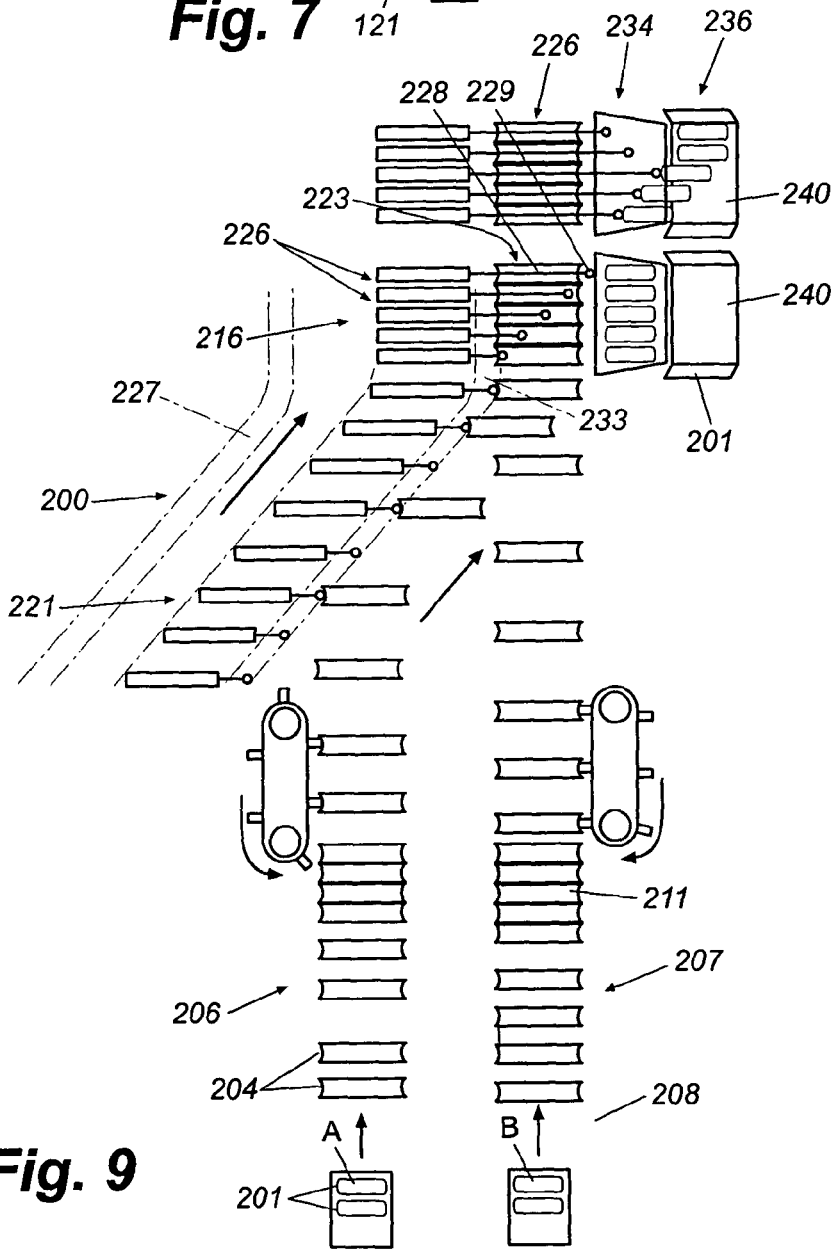
FIG. 9 is a schematic illustration of the feeding and merging of multiple lines of carriers in the embodiment of FIG. 8B.

In addition, guide rails 96 (FIG. 6) generally are provided along the side edges of the carrier transport conveyor 91, which guide rails typically are received within the side recesses 42 formed in the carriers 24. The guide rails 96 guide the carriers into and through the inserter unit and help maintain the carriers in a substantially upstanding, vertically oriented and closed attitude to prevent opening of the carriers and shifting of the products therein. FIG. 6 additionally illustrates a return line 101 for the carriers 24 along which the now empty carriers are routed back to their carrier conveyor 16 (FIGS. 1A and 1B) and loading station 45 for continued reuse and loading with additional products. The return line 101 (FIG. 6) can include multiple lanes 102 and 103 along which the carriers can be guided back to separate or different carrier conveyors in arrangements of the packaging system 10 of the present invention where the products are received from multiple product transport lines at multiple carrier conveyors that are merged into a downstream inserter unit such as shown in FIGS. 8 and 9. In such an embodiment of the packaging system, the carriers 24 typically will be formed with additional, asymmetric guide features 104 (FIG. 3A), such as a guide pin 106 mounted along one side edge of the carrier as indicated in FIGS. 3A and 3B, or by notching the side plates along one side edge, or through the use of other guide features. Such asymmetric guide features enable the carriers to be engaged by, for example, a guide rail or similar mechanism that directs the carriers to a selected one of the lanes 102 or 103 of the return line 101 to ensure that each carrier will be returned to its respective carrier conveyor to maintain the supply of carriers along each carrier conveyor at a relatively consistent level.

Figure 7:
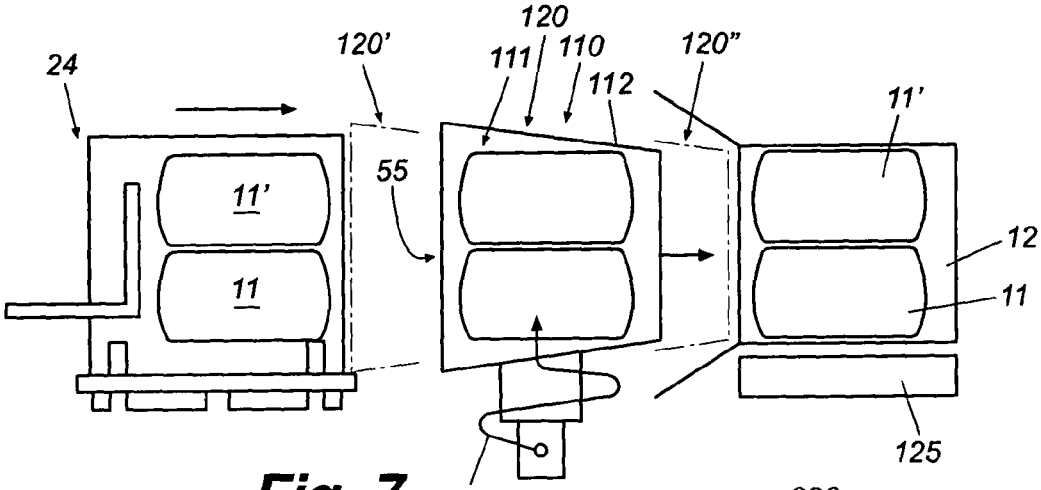
FIG. 7 is an end view schematically illustrating the insertion of stacks of products into a carton.

As further indicated in FIGS. 5 and 6, the inserter unit 17 also generally includes a funnel conveyor 110 that is mounted on the opposite side of the carriers 24 from the inserter assemblies 61. As indicated in FIG. 5, the funnel conveyor typically includes a series of spaced funnels 111 formed from first and second guide plates 112 and 113. The guide plates 112 and 113 generally are spaced apart at a sufficient size or width to receive a desired number or grouping of products, and are angled slightly inwardly and include a downwardly sloped upper portion 114. The guide plates thus define a funneling region or zone 116 through which a series or group 55 of products 11 will be directed for feeding into a carton 12. The funnel conveyor further includes a pair of spaced drive belts or chains 117 having a series of support plates 118 mounted thereon, which support the guide plates 112 and 113 of each of the funnels 111. The funnel plates additionally can be adjustable so as to increase or decrease the size of the funneling region 116 defined therebetween. The funnels are moved in timed series with the movement of the carriers 24 through the inserter unit so as to be matched up with a particular group of carriers or products for feeding the products into the cartons. As the products are received and urged through the funnels, the products are urged into a tighter, more compact arrangement to facilitate the insertion of the stacked products into their cartons, as shown in FIG. 7. Additionally, the funnels can have lateral movement to allow the funnel to move to the carrier between a first, central position 120, and a second, inner position 120' to receive the product; and then can be moved in unison with the inserter rods toward a third outer position 120" in registration with the carton 12, partially entering the carton flaps to ensure smooth transfer of the product without catching straws or fins, as indicated by arrow 121 on FIG. 7.

Additionally, as generally indicated in FIGS. 1B, 5 and 6, the cartons 12 generally are conveyed to and alongside the inserter unit on a carton conveyor 125, which generally moves the cartons adjacent the inserter unit at a rate approximately equivalent to the movement of the carriers through the inserter unit for receiving the products therein. The carton conveyor 125 further can include locator pins, indicated at phantom lines 126 in FIG. 5, which can be used to position cartons at desired intervals or spacings to receive groups of products being inserted therein using a pitched inserter unit 17 as shown in FIG. 5. Alternatively, with a pitchless inserter unit as indicated in FIGS. 1B and 6, the cartons can be run side by side or gapped slightly using alternative locator devices engaging into carton features. Still further, as indicated in FIG. 1B, the cartons 12 can be conveyed to the inserter unit 17 in a substantially upstanding attitude and reoriented to a horizontal, flat lying attitude with the open ends thereof facing the inserter assembly and with the carton flaps of each carton being spread or guided to an open position. Thereafter, once filled with products, the cartons can be conveyed away from the inserter unit for sealing and further processing downstream.

In operation of the packaging system 10 of the present invention, as illustrated in FIGS. 1A and 1B, a series of products 11 will be received from one or more product loading or transport conveyors 14/14' (FIG. 1B) at a loading station 45 at the upstream end of a carrier conveyor 16. The carrier return conveyor moves a series of carriers 24 into and through a loading position at the loading station wherein the side walls 29 (FIG. 4) of the carriers 24 are caused to spread apart to an opened receiving position to facilitate the loading of one or more products therein. The products can be fed from a single product transport conveyor 14 into their respective carriers as the carriers are incremented around the loading sprockets of the loading station, with the products typically being fed into the carriers in a substantially flat-lying, horizontally oriented attitude with one product stacked on top of another. Alternatively, where multiple product transport conveyors are used, a first one of the products 11' will be fed into each product carrier from the first one of the product transport conveyors 14 (FIG. 1B) and thereafter a second or additional product 11" will be fed into the carrier 24 from the second or additional product transport line 14'. After loading, the products are reoriented into a substantially upstanding attitude and the side walls of the carriers are urged together to a closed, transport position as shown in FIGS. 1A–1B and 4 by the engagement of side guide rails 23 of the carrier conveyor 16 within the side recesses 42 of the carriers, as the carriers are transported to the downstream inserter unit 17.

As illustrated in FIGS. 1A, 1B, 5, and 6, the carriers can be conveyed from the loader on the carrier conveyor to the downstream inserter unit 17. The carrier conveyor generally runs at a higher speed, gapping the loaded carriers moving away from the loading station and product transport conveyor to transport them to the downstream inserter unit. This allows the loading station(s) and carrier conveyor(s) to run independently from the inserter unit and allows some accumulation or buffer to exist between the two units to increase system efficiency. In the pitchless inserters, each of the carriers generally is engaged by and supported on a support bar 92 of a carrier conveyor 91 and with the side recesses of the carriers being typically engaged by side guide rails 96 in FIG. 6. Where a pitched inserter unit is used, such as is illustrated in FIG. 5, the carriers can be passed through a metering or selector station so as to select and/or separate the carriers into spaced groups 55 of a desired number of products. Alternatively, with a pitchless inserter, such as illustrated in FIG. 6, the carriers 24 can be fed directly into the inserter unit 17 and run back to back in a full complement, rather than requiring them to be fed through a metering and selecting unit or station for forming into groups or sets prior to introduction into the inserter unit.

As the carriers are moved through the inserter unit, a series of inserter assemblies 61 are moved in timed relation with the movement of the carriers through the inserter unit. Inserter or pusher rods 62 (FIG. 5) or 81 (FIG. 6) of each of the inserter assemblies 61 are progressively urged laterally across the width of the inserter unit into and through their respective carriers, as shown in FIGS. 5 and 6. As shown in FIG. 7, the inserter rods are moved progressively through the pockets of the carriers, so as to engage and push the stacks of products 11 contained therein out of the carriers and through an associated funnel 111. The funnels 111 tend to compact or direct the stacks of products into a more compact arrangement or group of products for insertion into a corresponding carton 12 passing adjacent the associated funnel as FIG. 7 illustrates. As a result, the cartons are automatically loaded with a complement or group of products, after which the cartons can be conveyed away from the packaging system 10 of the present invention for sealing and shipment. At the same time, as the cartons are being conveyed away from the inserter unit, the inserter rods are moved back to their retracted, non-engaging positions, while the carriers are directed along a carrier return line 101 back to their carrier conveyor 16 for continued use.

Figure 8A:
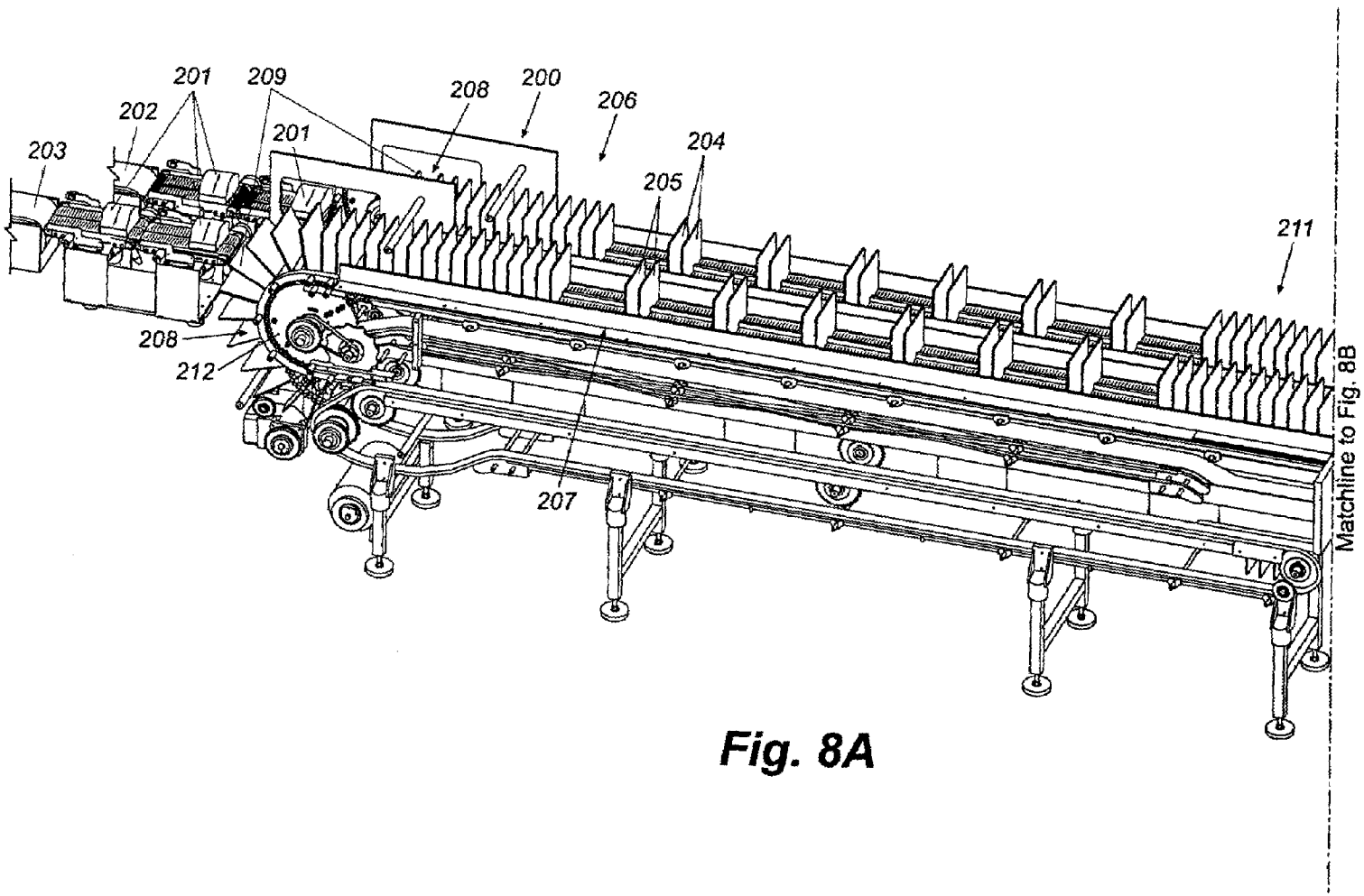
FIG. 8A is a perspective view of a further alternate embodiment of the packaging system of the present invention for receiving products from multiple product transfer lines.

FIGS. 8A–9 illustrate a further additional embodiment 200 of the packaging system of the present invention in which a series of products 201 are received from multiple product transport conveyors 202 an 203 and are fed into a series of carriers 204 and 205 of separate carrier conveyor lines 206 and 207. While FIG. 8A generally illustrates the multiple product transport conveyors 202 and 203 each feeding directly into a single, separate carrier conveyor line 206 or 207, it will further be understood by those skilled in the art that, as discussed with respect to FIG. 1B above, multiple product transport conveyors also can be provided to provide and load products 201 to each of the carrier conveyor lines 206 and 207, with such product transport conveyors alternatively feeding their products into the carriers 204 and 205 of the respective carrier conveyor lines 206 and 207.

Still further, in the event of gaps or other disruptions in the feeding of products along the product transport or conveyor lines, their associated carrier conveyor lines 206 or 207 can be controlled, such as by incrementing the carriers thereon at varying rates as needed to match the supply of products being received from the associated product transport conveyor. The downstream selector station accordingly will vary the feeding of the groups from ones of the carriers on each of the carrier conveyor lines to ensure a substantially full complement of carriers is received at the downstream inserter unit.

Figure 8B:
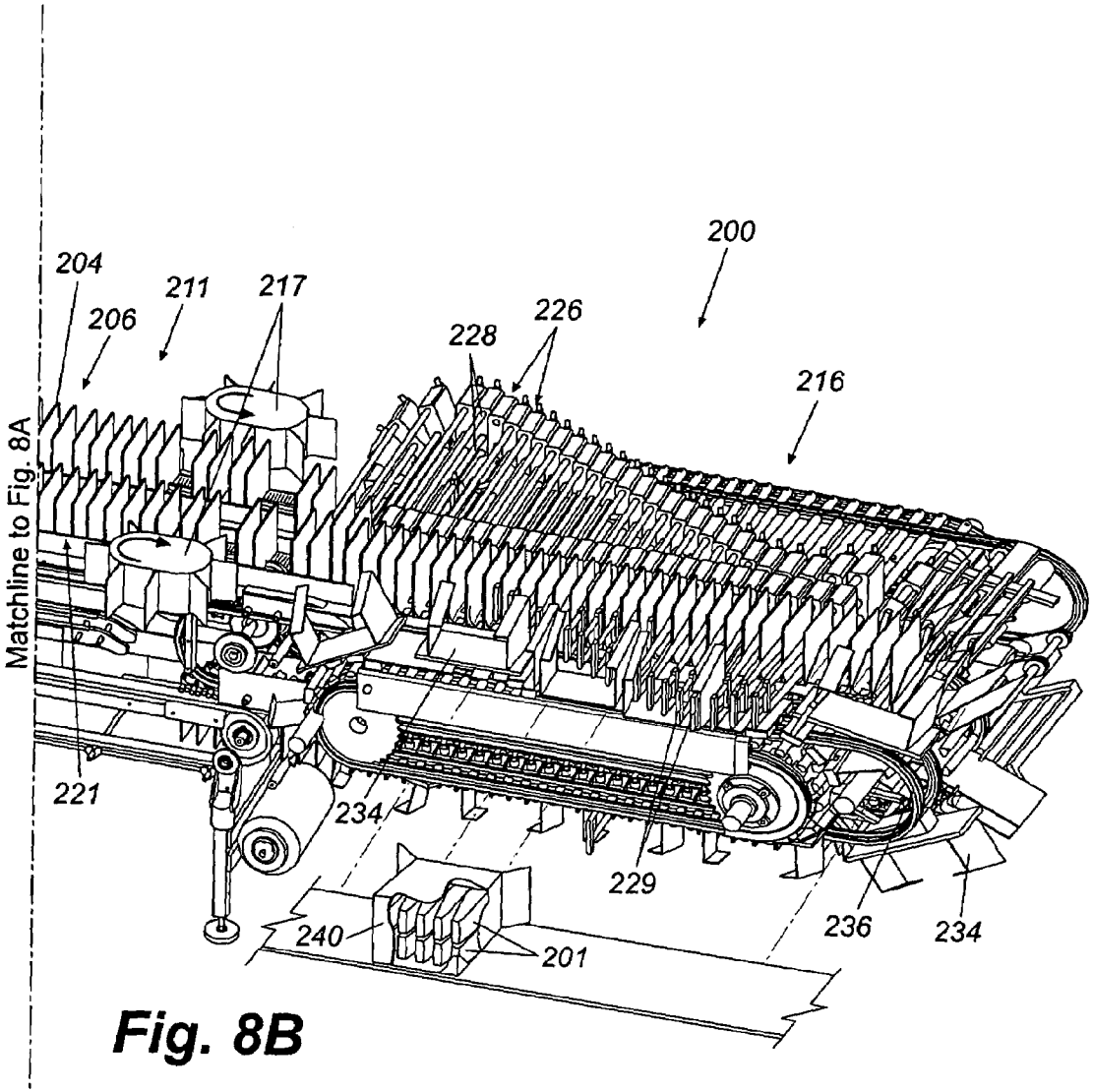
FIG. 8B is a perspective view of the downstream inserter unit of the packaging system of FIG. 8A for inserting from multiple product lines.

As shown in FIGS. 8A and 8B, each of the conveyor lines 206 and 207 generally includes a loading station 208 at an upstream end 209 thereof, and a downstream discharge end 211. The loading stations 208 generally each include loading sprockets 212 about which the carriers are engaged and cause to be spread apart to an open position to facilitate the loading of products therein. A selector station 215 generally is positioned at the downstream ends 211 of the carrier conveyor lines 206 and 207 for selecting and metering the carriers for feeding into a downstream inserter unit 216. The selector station 215 can include various types of selectors such as star wheels 217 shown in FIG. 8, or other, similar types of selector units such as a pair of selector belts 218 having pusher plates or fingers 219 mounted in spaced series thereabout as shown in FIG. 9.

The selector station 215 generally will control the feeding of the carriers with their products loaded therein into the downstream inserter unit 216. In a typical operation, the selectors of both conveyors would feed carriers alternately from each lane or one group at a time from each lane into the inserter unit. The selectors further can be controlled to feed more or less carriers from one of the carrier conveyor lines as needed. For example, in the event that an upstream product filling machine or system is becomes non-operational, and thus only one of the product transport conveyors is supplying products to the packaging system 200, the selectors can cause the feeding of carriers only from the carrier conveyor line associated with the operative product transport line into the downstream inserter unit.

As indicated in FIGS. 8A–8B and 9, the downstream inserter unit 216 typically will include a pitchless inserter unit, such as discussed above with respect to FIG. 6. The inserter unit typically will include an elongated carrier transport line 221 extending therethrough and having an upstream merging section 222 along which the carriers 204 and 205 from the different carrier conveyor lines 206 and 207 are merged together into a single line of carriers 223 moving through the inserter unit 216, as indicated in FIG. 9. As the carriers are merged into the single line of carriers 223 a series of inserter assemblies 226 also will be moved laterally across the width of the inserter unit 216, generally matching the movement of the carriers 204 and 205. The carriers can be guided via guide rails laterally across the inserter unit toward their merged position to form the single line of carriers, while inserter assemblies generally will be moved along cam tracks, such as indicated by dashed lines 227 (FIG. 9), toward the single line of carriers 223. The inserter assemblies thus will tend to track the movement of the outer line of carriers 205 as they are merged together with carriers 204, so that regardless of which carrier 204 or 205 is to be engaged by a particular one of the inserter assemblies, each carrier will have an inserter assembly substantially matched therewith.

As discussed above with regard to FIG. 6, the inserter assemblies each generally include an inserter rod 228 (FIG. 8B) having a pusher plate or finger 229 at a forward or proximal end thereof, with the inserter rod(s) 228 being slideably received within a carrier 231. A cam follower 232 generally is attached to each inserter rod 228 and is moved along a separate cam track, indicated by dashed line 233, so as to urge the inserter rods of the inserter assemblies from retracted, non-engaging position, into and through the carriers 204 and 205 and through funnels 234 of a funnel conveyor 236. As a result, the products 201 stacked within each of the carriers 204 and 205 are progressively urged out of their carriers through one of the funnels 234 and into a corresponding carton 240 for packaging of the products.

It will be understood by those skilled in the art that while the present invention has been discussed above with respect to various preferred embodiments and/or features thereof, numerous changes, modifications, additions and deletions can be made thereto without departing from the spirit and scope of the invention as set forth in the following claims.

What is claimed is:

1. A system for packaging products, comprising:

a series of carriers each adapted to receive at least one product therein;

an inserter unit that receives and moves the carriers in spaced series along a path of travel for packaging, and which includes a series of inserter assemblies adapted to engage and urge the products out of the carriers;

a carton transport conveyor moving a series of cartons in timed relationship with the movement of the carriers along their path of travel such that the products are received within the cartons as the products are urged out of the carriers by the inserter assemblies; and a funnel conveyor positioned between the inserter unit and the carton transport conveyor and having a series of funnels mounted therealong for guiding groups of the products into the cartons of the carton transport conveyor, so that for each of the funnels a respective group of the groups of the products passes through an upstream opening of the funnel and then through a downstream opening of the funnel while the funnel guides the respective group of the products into a respective carton of the cartons, and the funnel tapers so that the downstream opening of the funnel is narrower than the upstream opening of the funnel, wherein the system further comprises one or more carrier conveyors along which the carriers are loaded with products and are conveyed to the inserter unit, and wherein the system further comprises at least one selector unit positioned along the path of travel of the carriers upstream from the inserter unit for metering multiple lines of carriers being fed into the inserter unit.

2. The system of claim 1 and wherein the carton transport conveyor includes a series of spaced carton locator devices.

3. The system of claim 1 and wherein the inserter unit further includes a guide track adapted to be engaged by the carriers as they move along their path of travel for merging the carriers into a single line of carriers moving through the inserter unit.

4. The system of claim 1 and wherein the inserter assemblies each comprises an inserter rod slideably mounted to a support and moveable from at retracted, non-engaging position into an extended, engaging position for urging the products out of their carriers.

5. The system of claim 1 and further comprising a cam follower mounted to each inserter rod and engaging a cam track for moving each inserter rod between its engaging and non-engaging positions.

6. The system of claim 1 with the carrier conveyor having a loading station at an upstream end thereof wherein a series of products from at least one product transport line are received and loaded into each carrier.

7. The system of claim 6 and wherein the loading station receives products from multiple product transport lines which alternatively feed products into each carrier.

8. The system of claim 1 and wherein for each of the funnels, the upstream opening of the funnel is sized for simultaneously receiving the products of the respective group of the products respectively from a plurality of the carriers.

9. The system of claim 1 and wherein for each of the funnels, while the funnel is positioned for guiding the respective group of the products into the respective carton, the upstream opening of the funnel is wider than a downstream opening of a carrier that is adjacent to and open to the upstream opening of the funnel for passing some of the products of the respective group of the products into the upstream opening of the funnel.

10. The system of claim 1 and wherein for each of the funnels, while the funnel is positioned for guiding the respective group of the products into the respective carton, the upstream opening of the funnel is simultaneously adjacent to and open to a plurality of the carriers for simultaneously receiving the products of the respective group of the products respectively from the plurality of the carriers.

11. A system for packaging products, comprising:

a plurality of carrier conveyors each carrying a series of carriers and each having a loading station adapted to receive and load products from one of a series of product transport lines into the carriers of each carrier conveyor, and a selection station for feeding carriers from the plurality of carrier conveyors in alternating series;

an inserter unit that receives the carriers from the selection station and moves the carriers in spaced series along a path of travel for packaging, and which includes a series of inserter assemblies adapted to engage and urge the products out of the carriers; and a carton transport conveyor moving a series of cartons in timed relationship with the movement of the carriers along their path of travel such that the products are received within the cartons as the products are urged out of the carriers by the inserter assemblies.

12. The system of claim 11 and wherein the carriers each include a pair of opposed side plates pivotally connected and which have an asymmetric feature to enable each carrier to be directed and feed back to a desired one of the carrier conveyors.

13. A method of packaging products in cartons of varying sizes, comprising:

placing the products in a series of carriers moving along a plurality of carrier conveyors;

alternatively feeding the carriers from each of the plurality of carrier conveyors into an inserter unit and merging the carriers into a line of carriers moving through the inserter unit;

moving a series of inserter assemblies in timed relation with the carriers moving along their path of travel through the inserter unit;

moving the cartons along a path substantially parallel to and in registration with the carriers; and engaging and urging the products out of the carriers and into the cartons for packaging.

14. The method of claim 13 and wherein feeding the carriers into an inserter unit comprises selecting and metering multiple lines of carriers into a single line of carriers moving through the inserter unit.

15. The method of claim 13 and wherein placing the products in carriers comprises loading a least one product into each carrier with the product oriented substantially horizontally.

16. The method of claim 15 and further comprising loading a second product within each carrier, with the products positioned in a stacked, substantially parallel arrangement.

17. The method of claim 13 and wherein placing the products within the carriers comprises opening the carriers for receiving the products therein, and placing a series of products within the carriers in a stacked arrangement.

18. The method of claim 13 and further comprising moving the products through funnels as the products are urged out of their carriers, and guiding groups of stacked products into each carton.

19. The method of claim 13 and wherein moving the cartons along their path further comprises guiding the cartons toward the carriers from an outer location spaced from the path of travel of the carriers to an inner location adjacent the carriers.

20. The method of claim 13 and wherein placing the products in the carriers comprises loading at least one product in each carrier from a loading conveyor and moving the carriers away from the loading conveyor at a higher rate than the products are moved along the loading conveyor.

21. In a system for packaging a series of irregularly shaped products in cartons, the improvement comprising:

a series of carriers moveable along a carrier conveyor between a loading station at an upstream portion of said carrier conveyor at which the products are received in stacked series within a pocket of each of said carriers and a downstream position for unloading the products from said carriers into the cartons; and said carriers each comprising a pair of opposed side walls defining a product receiving pocket therein of a sufficient size to receive a series of products in stacked arrangement, and actuation pins adapted to engage a loading sprocket at said loading station as said carriers are passed through said loading station, so as to cause said side walls to be moved away from each other so as to expand said receiving pocket as the products are loaded in their carriers.

22. The system of claim 21 and wherein each of the said carriers includes an asymmetric feature along one of said side walls to guide the products into their stacked arrangement.

23. The system of claim 21 and wherein said carriers each comprise a pair of opposed plates each including an upper wall and a base portion and wherein said base portions of said plates are pivotally connected by a hinge pin.

24. The system of claim 21 and further comprising an inserter unit adjacent said downstream end of said carrier conveyor and having a plurality of inserter assemblies, wherein as said carriers are received and move through said inserter unit, said inserter assemblies engage and urge the products within each of said carriers into a corresponding carton.

25. The system of claim 21 and wherein said carrier conveyor includes guide rails and said carriers each include channels adapted to receive said guide rails therein.

* * * * *